US005101756A

United States Patent [19]

Strumbos

[11] Patent Number: 5,101,756

[45] Date of Patent: Apr. 7, 1992

[54] MARKER ARROW SYSTEM

[76] Inventor: William P. Strumbos, 85 Middleville Rd., Northport, N.Y. 11768

[21] Appl. No.: 636,421

[22] Filed: Dec. 31, 1990

[51] Int. Cl.[5] ..... B42D 9/00; B42F 21/06

[52] U.S. Cl. ..... 116/234; 116/235; 116/240

[58] Field of Search ..... 116/234, 235; 281/42; 206/813, 820; 283/37–43; 428/42, 43, 194

[56] References Cited

U.S. PATENT DOCUMENTS

| | | | |
|---|---|---|---|
| 3,583,358 | 6/1971 | Hanson, Jr. | 116/235 |
| 4,448,310 | 5/1984 | Hodgson | 206/526 |
| 4,609,208 | 9/1986 | Wrobel | 283/81 |
| 4,661,189 | 4/1987 | Voy et al. | 156/248 |
| 4,680,210 | 7/1987 | Corcoran | 428/42 |

FOREIGN PATENT DOCUMENTS

| | | | |
|---|---|---|---|
| 1761635 | 7/1971 | Fed. Rep. of Germany | 116/234 |
| 2262100 | 6/1974 | Fed. Rep. of Germany | 116/234 |
| 2551697 | 3/1985 | France | 116/234 |

*Primary Examiner*—William A. Cuchlinski, Jr.
*Assistant Examiner*—W. Morris Worth

[57] ABSTRACT

A self-sticking removable marker arrow system in which a series of consecutive marker arrows are defined either transversely or longitudinally on a strip of sheet material with a pressure sensitive adhesive being applied on the strip on the contact surface of the marker arrows in the area of the heads and at least some of the area of the shafts thereof. Means are provided such that individual marker arrows can be detached from the others on the strip for use as a removable marker or signal on a document and in tailoring and dressmaking and the like.

10 Claims, 2 Drawing Sheets

14
12

10
16
20
18
22
12

10
24
28
30
26
12
32

10
22
32
34
12
30
38
36

44
12
34
32
34
38

42
114
32
40

110
112
115
131

128
126
116
120
122
118
128
126
132
124
130
133
116
130
120
132
118
123

134
132
122
124
130
133
136
130
134
123
132

FIG.5
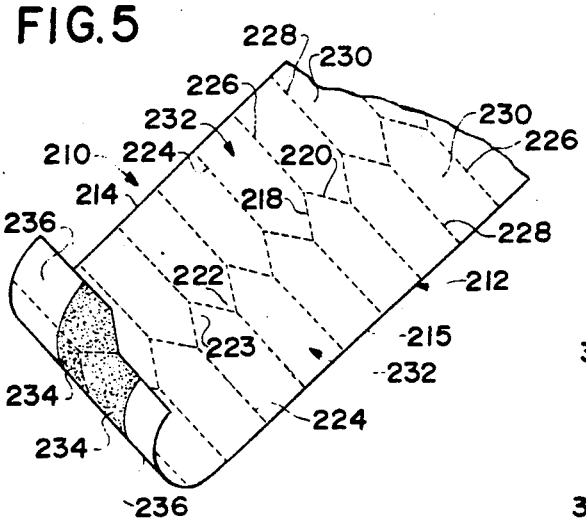
FIG.6
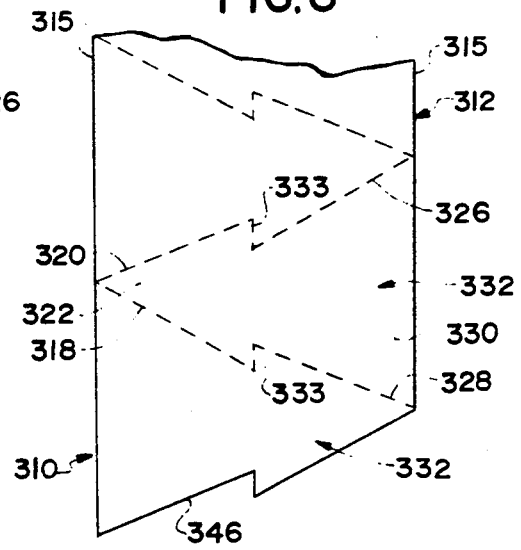
FIG.7
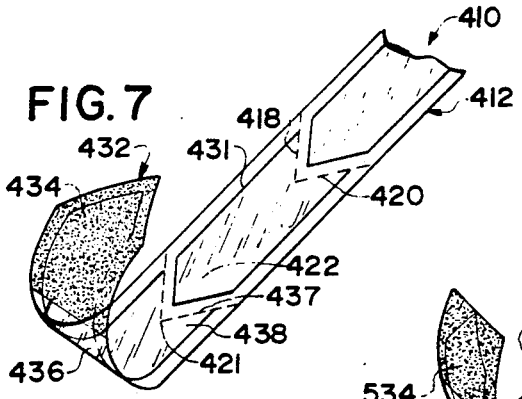
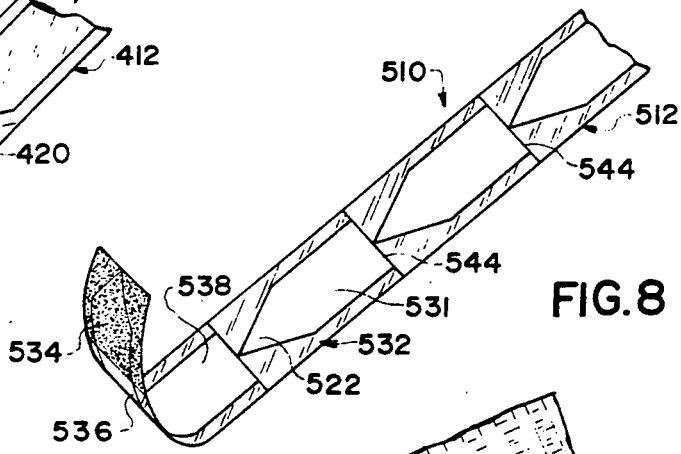
FIG.8
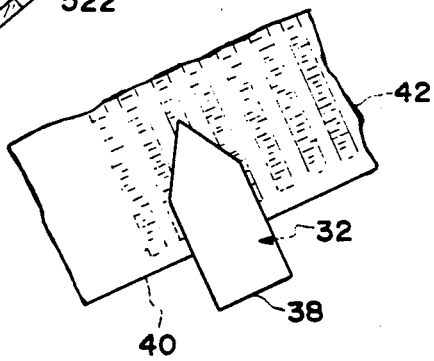
FIG. 9
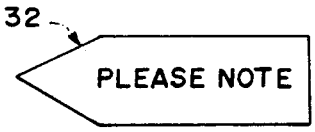
FIG.10a
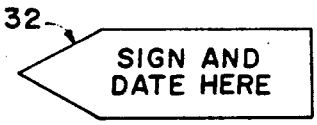
FIG.10b
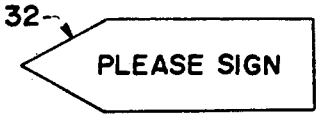
FIG.10c
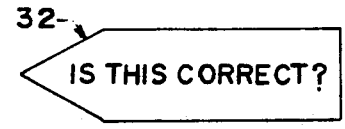
FIG.10d

MARKER ARROW SYSTEM

FIELD OF THE INVENTION

This invention relates to marker arrows and signals and, more particularly, to self-sticking removable marker arrows for documents and the like.

BACKGROUND OF THE INVENTION

It is the practice when a draft of a paper or other document is being read or edited and it is desired to make note of a passage of interest or of necessary revisions, to enter the note or change thereon in red pencil or in ink. Where the document is of a nature such that the marking or note has to be removable, it is lightly penciled in so that it can be erased. If the penciling is done too lightly, a loss of legibility may result; if it is entered too darkly, there is a risk that complete erasure is not possible or that the erasing itself can cause damage. It is thus the practice to use removable markers or signals of various kinds to point out, note, or emphasize matter of interest in a paper or other document.

SUMMARY OF THE INVENTION

The present invention is a marker arrow system providing self-sticking, removable marker arrows, which can be made up in rolls or packs or pads, such that individual marker arrows can be conveniently detached therefrom for use to mark a document. In this system, the underside (the faying or contact surface of the sheet material on which the marker arrows are defined) of at least the head and areas of the shaft of each marker arrow are provided with a pressure sensitive adhesive such that a marker arrow detached from the roll or pad can be affixed to a document to mark passages, to emphasize, indicate, or mark areas of interest therein; the marker arrow being removable without damage to the document after the marker arrow has served its purpose. The marker arrow can be made of a substantially stiff material such that the end of its shaft can protrude from the edge of the document to act as a signal; with less rigid material, the shaft itself can be doubled over or treated with a suitable sizing to impart sufficient rigidity for the purpose. The material of the shaft can be mechanically scored to facilitate the doubling over of the material.

The invention is characterized in various embodiments with the marker arrows being defined on a strip of suitable sheet material such as paper or an appropriate plastic such as polyester or polyvinyl. The material can be opaque or transparent to suit the application. In one embodiment, one edge of a strip or ribbon of material is notched such that the heads of consecutive marker arrows are formed thereby and transverse incisions and/or perforations are provided along the consecutive shafts of the marker arrows, the incisions enabling an individual marker arrow to be detached for use. In a further embodiment, both edges of the strip are notched to form the heads and transverse incisions define the edges of the shafts of marker arrows positioned end-to-end with longitudinal incisions extending the length of the strip intermediate the edges thereof defining the butt ends to allow individual marker arrows to be detached for use. In yet another embodiment, the head of each consecutive marker arrow nests against the shaft of the adjoining arrow in a head to butt relationship with incisions defining the heads and shafts to enable individual marker arrows to be detached for use.

In an alternate embodiment, the side edges of the strip define the butt ends of consecutive marker arrows with the heads of adjacent arrows nesting intermediate the side edges. Again, the individual marker arrows are defined by incisions to enable them to be detached for use. Another embodiment is characterized by a strip of material with longitudinally extending marker arrows printed thereon, with incisions enabling a marker arrow to be detached from the strip for use.

DESCRIPTION OF THE PRIOR ART

It is common practice when noting a passage of interest or when a signature or other attestation is required on a document, to slip an ordinary wire paper clip on the edge of the page concerned as a marker or signal. Other well known page edge markers and signals in a wide variety of configurations and materials have been widely available for years. However, most of these prior art devices are time consuming and inconvenient to use and the protruding edges thereof, particularly of those made of sheet metal, can result in personal injury and can cause damage to the document itself or to other documents attached or adjacent thereto. A marker having rounded edges to minimize the possibility of personal injury is a colored plastic paper clip marketed by Acco International Inc., Chicago, Ill. 60619. The device is useful for color coding files, for book marks and for signals. A disadvantage of paper clips, whether of plastic or metal wire, in addition to their inconvenience in use, is that they leave unsightly indentations of often a permanent nature on the edge of the document with which they are used. Also, they are bulky, particularly when used on a number of pages of the documents and they are unprofessional in appearance. Further, markers or signals at the edge of a document are not too helpful in pointing out precisely matter of interest away from the edge.

A further well-known form of marker that has been commercially available for years is of the stick-on or transfer type. Stick-ons and transfers, such as those marketed, for example by Letraset USA Inc., Paramus, N.J., are available in strips or sheets. However, they require that individual marker symbols or characters be cut out for application to the work or to be transferred thereon by rubbing or burnishing with a special tool. Perhaps this lack of convenience and their more or less permanent nature has militated against their more widespread use.

The recent introduction by 3M, St. Paul, Minn. 55144, and other firms of packs or pads of various sizes of self-sticking removable note paper from which individual sheets can be detached for use have added a new medium of communication. The detached sheets can be written upon and removably affixed to a surface. They have become widely used in commerce and domestically for notes, notices, and informal memoranda. Although this type of self-sticking paper can be used as markers or signals without the disadvantages of the other marker and signal means discussed previously herein, they are not specific enough without detailed instructions written thereon to be readily intelligible for conveniently pointing out the specific location of an area of interest or precisely where a signature or attestation should be entered. Thus, although this self-sticking, removable note paper has a number of advantages over prior markers or signals, it has not supplanted them and there remains a need for a convenient and precise marker or signal system for use on documents.

It is, therefore, a principal object of the present invention to provide a marker arrow system that is inexpensive, convenient to use, and if need be, to reuse, that is readily intelligible, and is specific in indication.

It is a further object of the invention to provide a marker arrow system that can be used as a conspicuous signal or marker, that is convenient and easy to apply and remove; and that is not bulky or of a nature that can cause personal injury or result in damage to the document with which it is used.

The invention will be better understood from the accompanying description with reference to the drawings which show the marker arrow system according to the invention.

DESCRIPTION OF THE DRAWINGS

For the purpose of illustrating the invention, there is shown in the drawings the forms which are presently preferred; it should be understood, however, that the invention is not necessarily limited to the precise arrangements and instrumentalities here shown.

FIG. 5 is a perspective view of a further embodiment of the marker arrow system of the invention;

FIG. 6 is a plan view of yet another embodiment of the invention;

FIGS. 7 and 8 are perspective views of yet further embodiments of the invention having the marker arrows oriented longitudinally on a strip of sheet material;

FIG. 9 is a perspective view of an alternate version of the marker arrow of the invention in use as a signal at the edge of a document; and FIGS. 10*a*–10*d* are plan views of marker arrows according to the invention inscribed with various indicia.

Figures 1A, 1B, 1C, 1D, 2, 3, 4A, 4B, 4C:
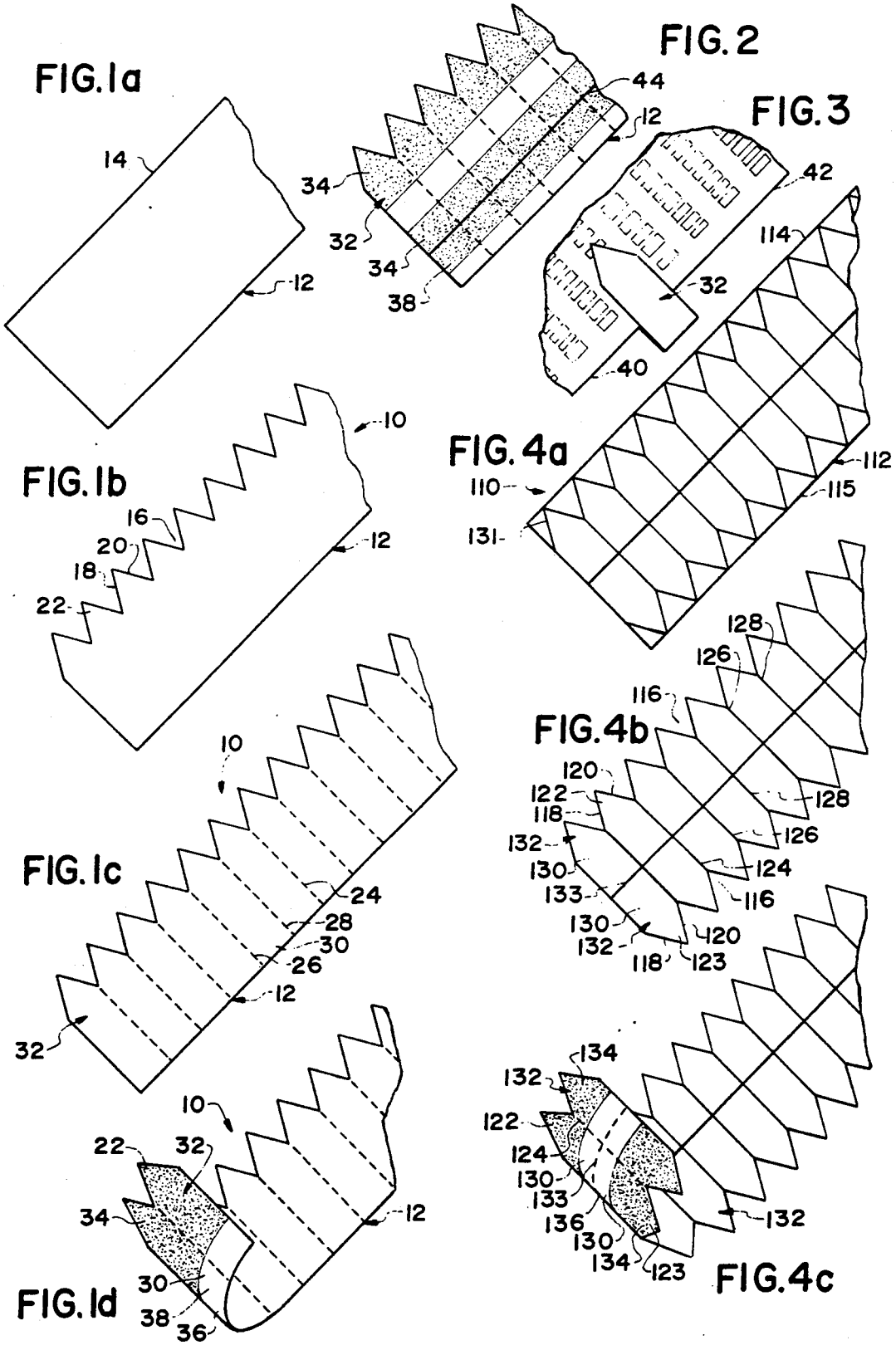
FIGS. 1*a* through 1*d* are perspective views of an embodiment of the marker arrow system according to the invention illustrating the steps in the making thereof from a strip of sheet material with FIG. 1*d* showing the end of the strip of marker arrows curled up to show the application of a pressure-sensitive adhesive to the contact surface of the marker arrows.
FIG. 2 is a perspective view of the contact surface of the marker arrow system of FIGS. 1*a*–1*d* showing the application of adhesive to an alternate version thereof.
FIG. 3 is a perspective view of a marker arrow of FIG. 2 in use as a signal on the edge of a document.
FIGS. 4*a*–4*c* are perspective views of an alternate embodiment of the marker arrow system of the invention with FIG. 4*c* showing the end of the strip of marker arrows curled up to illustrate the application of adhesive to the contact surface thereof.

With reference now to FIGS. 1*a*–1*d* of the drawings illustrating the marker arrow system 10 of the invention embodied in a preferred strip form. In this embodiment, a strip 12 of a suitable sheet material, preferable paper, has one side edge 14 notched 16 with the notches having sides 18, 20 of equal angles such that a consecutive series of arrowheads 22 are formed. Following the notching, or prior to or concurrently therewith, the strip 12 is cut or perforated 24 transversely to form the consecutive edges 26, 28 of the shafts 30 of the marker arrows 32 of the invention. It will be appreciated that in addition to defining the shafts the function of the cuts, incisions, or perforations 24 is to enable individual marker arrows 32 to be detached readily and conveniently from the other marker arrows in the strip 12 for use; thus, the cuts can be a series of short slits extending transversely across the strip or the perforations can be a transverse series of minute holes such as used for postage stamps. It will be appreciated that the transverse cut can extend across the width of the strip except for small sections of the strip adjacent the head and butt ends of each marker arrow that will maintain the marker arrows together in the strip until it is desired to detach one or more from the strip for use. It will be recognized that, in this system, the strip 12 can be of an opaque colored material such that the individual marker arrow 32 thereof are defined by the notching and/or perforating or slitting steps. The individual marker arrows can also be defined by printing a consecutive sequence of marker arrows on the strip, particularly if the strip is of a transparent material.

A suitable low-tack pressure-sensitive contact adhesive 34 is applied to the underside 36 (The contact or faying surface of the marker arrows or the surface thereof that will be affixed in use to a document.) of the strip 12 in the area of the marker arrow heads 22 and at least a portion of the shafts 30. As illustrated in FIG. 1*d*, the area 38 of the butt end portion of the strip can be left adhesive-free to facilitate lifting the marker arrow off the document when it is desired to remove it after it has served its purpose.

However, as indicated in FIG. 2 an area of the butt end area 38 of the strip 12 can be provided with a contact adhesive 34 such that the butt end of a marker arrow 32 can be folded over on the edge 40 of a document 42 (see FIG. 3) to form a signal. A transverse score 44 can be provided to facilitate folding over the butt end of the marker arrow.

In a further embodiment of the marker arrow system 110 of the invention as illustrated in FIG. 4*a*, a strip 112 of suitable sheet material is printed 131 with a consecutive series of transverse butt to butt double headed arrows and subsequently has both side edges 114, 115 of the strip notched 116 (see FIG. 4*b*) with the notches having sides of equal angles 118, 120 such that a consecutive series of arrowheads 122, 123 are formed in the edges 114, 115 respectively of the strip 112. As in the previous FIGS. 1*a*–1*d* embodiment, the strip 112 is cut or perforated 124 transversely to form the consecutive edges 126, 128 of the shafts 130 of marker arrows 132 and the strip is cut or perforated 133 longitudinally intermediate the strip sides (see FIG. 4*b*). The transverse and longitudinal cuts or perforations permit individual marker arrows 132 to be readily detached for use from the strip 112. As shown in FIG. 4*c*, a suitable low-tack contact adhesive 134 is applied to contact surface 136 of the strip in the area of the marker arrow heads 122, 123 and at least a portion of the area of the marker arrow shafts 130.

A yet further marker arrow system 210 of the invention is illustrated in FIG. 5 which shows a strip of sheet material 212 having a consecutive series of marker arrows 232 with their arrowheads 222, 223 nesting intermediate the side edges 214, 215 of the strip. As in the previous embodiments transverse cuts or perforations 224 define the consecutive edges 226, 228 of the shafts 230 of the marker arrows and angled cuts or perforations 218, 220 define the arrowheads 222, 223. As was also the case in the previous embodiment, a suitable low-tack contact adhesive 234 is applied to contact surface 236 of the strip in appropriate areas thereof such that an individual marker arrow detached from the strip can be used as a marker or signal.

A further embodiment featuring transverse nesting marker arrow system 310 is illustrated in FIG. 6 which shows a strip of suitable sheet material 312 having a consecutive series of marker arrows 332 with the head of the first marker arrow from the end 346 of the strip 312 nesting against the shaft of the adjacent marker arrow and the shaft of the first marker arrow nesting against the head of the adjacent marker arrow in an alternating head to butt relationship along strip 312. Cuts or perforations 326, 328 angled with respect to side edges 315 of the strip define the shafts of the arrows 332 and cuts or perforations 318, 320 angled with respect to the side edge 315 define the heads 322 of the marker arrows and short longitudinal cuts 333 intermediate and parallel to the side edges of the strip join the base of the arrowheads to the shafts thereof. It will be appreciated that, in this embodiment as well as the previous embodiments, the end of the strip lying outside the marker arrows on the strip will be notched or otherwise suitably cut away such that the endmost marker arrow or arrows are ready to be detached for use without further preparation. As in previous embodiments of the invention, a suitable low-tack contact adhesive is applied to the contact surface of strip 312 in appropriate areas thereof in accordance with the invention.

A further preferred embodiment 410 of the invention in which the marker arrows 432 are longitudinally nested on the strip 412 of sheet material is shown in FIG. 7. Strip 412 can be made of a transparent material such as, for example, cellulose acetate or polyester, having printed 431 thereon at least the opaque outline of the marker arrows 432 arranged in sequence with the longitudinally succeeding arrows nesting with the points 421 of their arrowheads 422 in notches 437 in the butt ends 438 of their preceding marker arrow. The notches are cut or perforated 418, 420 such that the marker arrows 432 can be detached for use. As in the previous embodiments, a suitable low-tack contact adhesive 434 is applied in appropriate areas of the contact surface 436 of the marker arrows 432.

In yet another preferred embodiment of the marker arrow system 510 of the invention illustrated in FIG. 8, the marker arrows 532 are printed 531 on a transparent strip 512 of material in longitudinal sequence. Unlike the FIG. 7 embodiment, however, the head 522 of succeeding marker arrows 532 does not nest or fit into the butt 538 of the preceding marker arrow. When a marker arrow 532 is required for use, it is detached on a line transverse the strip. To assist in this operation, the strip 512 can be scored or incised 544 to facilitate the detaching of marker arrows for use. In accordance with the invention, appropriate areas of the contact surface 536 are provided with a suitable low-tack adhesive 534.

It will be recognized that, although the marker arrows of this invention are embodied in a strip form, it is known to wind the strip into a roll for convenience in packaging, shipping, retailing, and use. As is also well known, the strip can be wound on a core and provided with suitable dispensing means such as those conventionally furnished for dispensing tape.

It is also known to cut the strips with the marker arrows of the invention thereon into sections containing a number of marker arrows such that the sections can be stacked and a backing glue can be applied to one edge of the stack in a conventional manner to form a pack or pad of marker arrows. The sections can be stacked on a backing piece which can be of cardboard. With a backing piece, the cuts or perforations between the individual marker arrows can be such that the individual marker arrows are substantially severed one from the other to facilitate their being detached from the pad for use.

As has been described previously herein, the marker arrows of the invention can be made of any suitable known sheet material such as paper, cellulose acetate, polyester, and the like. A colored material can be used such that the marker arrows are defined by the notching and/or perforating and slitting steps or they can be printed on an opaque or transparent material prior to those steps. If the marker arrows are to used as signals protruding from the edge of a document, they can be made of a rigid material. However, as shown in FIG. 3, the butt end of the marker arrow can be doubled over in use to thereby import a measure of rigidity thereto. The marker arrows can also be stiffened, as illustrated with an individual marker arrow 32 in FIG. 9, by treating the butt ends 38 thereof with an appropriate known sizing such that they can be used as signals protruding from the edge 40 of a document 42. To increase the utility of the marker arrows in various applications thereof, indicia or indications of various kinds, for example, as shown in FIG. **10*a*–10*d***, can be inscribed thereon. It will be appreciated that, in lieu of indicia, the user can write in any suitable note, comment, or instruction.

Although the exposition of the invention has emphasized the use of the marker arrows for marking documents and the like it will be appreciated that they can be used in other applications. For example, the marker arrows can be used in dressmaking and tailoring in the place of the chalk marking means and pins conventionally used. Other applications will become apparent in other field of art; thus, I do not wish to restrict myself to the particular constructions described and illustrated, but desire to avail myself of all modifications that may fall within the scope of the appended claims.

Having thus described my invention, what I claim is:

1. A method for making marker arrows to be used as temporary markers or signals in the editing and the like of documents and in tailoring and dressmaking, comprising the steps of:

defining a series of consecutive marker arrows oriented transversely and spanning the entire width of a strip of sheet material by notching at least one side edge of said strip to form the heads of said marker arrows and generally transversely incising said strip to form the shafts thereof such that said marker arrows are detachable one from the others;

applying a pressure-sensitive permanently tacky contact adhesive on the faying surface of said strip of marker arrows on the heads and an area of the shafts thereof such that individual marker arrows detached from said strip can be pressed manually on a surface to serve as removable markers or signals; cutting said strip into sections containing a number of number arrows;

Stacking a plurality of said sections one on the other to form a pad of detachable marker arrows.

2. The method recited in claim 1 including the step of printing the series of consecutive marker arrows on the strip of sheet material prior to the notching and incising thereof.

3. The method recited in claim 1 including the steps of notching both side edges of the strip of sheet material to define the heads of the series of consecutive marker arrows.

4. The method recited in claim 1 including the step of treating the strip of sheet material at least in a butt end portion of each marker arrow shaft to make it rigid to serve as a signal when the marker arrows are positioned on a document with the butt end portion thereof protruding from the document edge.

5. The method recited in claim 4 wherein the step of treating includes sizing the strip of sheet material to make it rigid.

6. The method recited in claim 1 including the step of traversely scoring a butt end portion of each marker arrow shaft such that said butt end portion in use can be readily folded over on itself with the faying surface in contact with an edge portion of a document that is being marked and the edge portion of the document is interposed folded-over portions of said butt end portions between whereby a length of the folded-over portion protrudes from said edge to serve as a signal.

7. A method of making marker arrows to be used as temporary markers and signals in the editing and the like of documents and in tailoring and dressmaking, comprising the steps of:

Defining a series of consecutive marker arrows oriented longitudinally and spanning the entire width of a strip of sheet material;

applying a pressure-sensitive permanently tacky contact adhesive on the faying surface of said marker arrows on the heads and an area of the shafts thereof; and winding said strip into a coil of marker arrows on a core beginning with the arrowhead end of said strip such that an adhesive-free end of said marker arrows is presented such that each marker arrow can be grasped and detached for use from the coil of marker arrows.

8. The method recited in claim 7 including the step of mounting the wound coil of marker arrows on dispensing means.

9. The method recited in claim 7 including the step of treating at least portions of the adhesive-free end of the marker arrows to stiffen them to serve as a signal when the marker arrows are positioned on a document with the stiffened portion thereof protruding from the document edge.

10. The method recited in claim 7 including the step of transversely scoring a butt end portion of each marker arrow shaft such that said butt end portion in use can be readily folded over on itself with the faying surface in contact with an edge portion of a document being marked and the edge portion of the document is interposed between folded-over portions of said butt end portion whereby a length of the folded-over protrudes from said edge to serve as a signal.

* * * * *